US011371295B2

(12) United States Patent
Nguyen

(10) Patent No.: US 11,371,295 B2
(45) Date of Patent: Jun. 28, 2022

(54) WELLHEAD CONNECTOR SOFT LANDING SYSTEM AND METHOD

(71) Applicant: Dril-Quip, Inc., Houston, TX (US)

(72) Inventor: John Q. Nguyen, Cypress, TX (US)

(73) Assignee: Dril-Quip, Inc., Houston, TX (US)

( * ) Notice: Subject to any disclaimer, the term of this patent is extended or adjusted under 35 U.S.C. 154(b) by 155 days.

(21) Appl. No.: 16/850,693

(22) Filed: Apr. 16, 2020

(65) Prior Publication Data

US 2021/0324687 A1 Oct. 21, 2021

(51) Int. Cl.
*E21B 17/00* (2006.01)
*E21B 17/14* (2006.01)
*E21B 17/10* (2006.01)

(52) U.S. Cl.
CPC ..... *E21B 17/1007* (2013.01); *E21B 17/006* (2013.01); *E21B 17/1085* (2013.01); *E21B 17/14* (2013.01)

(58) Field of Classification Search
CPC ..... E21B 17/1007; E21B 17/006; E21B 17/1085; E21B 17/14
See application file for complete search history.

(56) References Cited

U.S. PATENT DOCUMENTS 3,640,485 A * 2/1972 Mutrux ..... B64C 27/20 244/12.2
4,175,620 A * 11/1979 Nolan, Jr. ..... E21B 43/0135 166/343
4,386,656 A * 6/1983 Fisher ..... E21B 33/047 166/117.5
4,544,036 A * 10/1985 Saliger ..... E21B 43/0135 166/341
4,570,716 A * 2/1986 Genini ..... E21B 17/015 166/346
4,620,818 A * 11/1986 Langner ..... E21B 43/0135 166/343
4,702,320 A * 10/1987 Gano ..... E21B 19/002 166/341
5,247,997 A * 9/1993 Puccio ..... E21B 33/043 166/208

(Continued)

FOREIGN PATENT DOCUMENTS

GB 2209550 A 5/1989
GB 2318373 A 4/1998

OTHER PUBLICATIONS

Search Report issued in related Great Britain Patent Application No. 2104996.0 dated Dec. 24, 2021, 1 page.

*Primary Examiner* — Aaron L Lembo
(74) *Attorney, Agent, or Firm* — Baker Botts L.L.P.

(57) ABSTRACT

Systems and method for providing a soft landing of a wellhead connector onto a subsea wellhead are provided. One such system includes a wellhead connector configured to be coupled to a subsea wellhead, and a soft landing system disposed on a body of the wellhead connector. The soft landing system includes one or more cylinder assemblies coupled to the body of the wellhead connector, and one or more valve assemblies coupled to the body of the wellhead connector. Each cylinder assembly includes a barrel, a rod disposed within the barrel and extending in one direction from the barrel, and a pad attached to an extended end of the rod. The one or more valve assemblies are each fluidly coupled to the one or more cylinder assemblies.

20 Claims, 6 Drawing Sheets

(56) References Cited

U.S. PATENT DOCUMENTS

| | | | | |
|---|---|---|---|---|
| 5,273,376 | A * | 12/1993 | Ritter, Jr. | E21B 33/038 405/169 |
| 6,460,621 | B2 * | 10/2002 | Fenton | E21B 33/0355 166/347 |
| 6,516,876 | B1 * | 2/2003 | Jennings | E21B 33/043 166/208 |
| 6,581,691 | B1 * | 6/2003 | Jennings | E21B 33/043 166/348 |
| 8,066,076 | B2 * | 11/2011 | Donald | E21B 43/36 166/344 |
| 8,443,898 | B1 * | 5/2013 | McClinton | E21B 17/1085 166/363 |
| 8,448,701 | B1 * | 5/2013 | McClinton | E21B 17/1007 166/86.1 |
| 8,567,493 | B2 * | 10/2013 | June | E21B 33/0355 166/212 |
| 8,613,323 | B2 * | 12/2013 | Garbett | E21B 33/038 166/368 |
| 8,931,561 | B2 * | 1/2015 | Baker | E21B 19/002 166/341 |
| 9,062,513 | B2 * | 6/2015 | Pallini, Jr. | E21B 33/038 |
| 9,540,894 | B2 * | 1/2017 | June | E21B 33/0355 |
| 2011/0247798 | A1 * | 10/2011 | June | E21B 33/043 166/67 |

* cited by examiner

WELLHEAD CONNECTOR SOFT LANDING SYSTEM AND METHOD

TECHNICAL FIELD

The present disclosure relates generally to subsea production equipment and, more particularly, to a soft landing system and method for landing a wellhead connector onto a wellhead.

BACKGROUND

Offshore oil and gas operations typically involve drilling a wellbore through a subsea formation and disposing a wellhead at the upper end of the well (e.g., at the mudline). A string of casing can be landed in the wellhead. A tubing hanger lands in the wellhead, and the tubing hanger suspends a production tubing string through the wellhead into the casing string. A subsea production tree, tubing spool, or other subsea equipment components can be connected to the top of the wellhead, and this equipment is used to route product from the tubing hanger (and production tubing) toward a topside facility. Other subsea production components such as pipelines, manifolds, flowline connectors, and so forth may be attached to the production tree to route product to a topside facility.

The subsea tree installed above the wellhead functions as a well control device for the production assembly. During installation, the subsea tree is typically lowered toward the wellhead via a drill pipe, riser or downline extending downward from a surface vessel. The subsea tree may include one or more guide features such as a funnel or guide post to center the subsea tree over the wellhead. The subsea tree is lowered to a desired vertical position with respect to the wellhead, and then a wellhead connector on the tree may be actuated to fully lock the tree to the wellhead. However, positioning the tree at this desired location over the wellhead can be difficult and inefficient, leading to delays in the installation of the subsea production system. In particular, if the tree is lowered over the wellhead too quickly, this can lead to undesired impacts between the subsea equipment, damaging the tubing hanger, wellhead, tree, or associated gasket.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
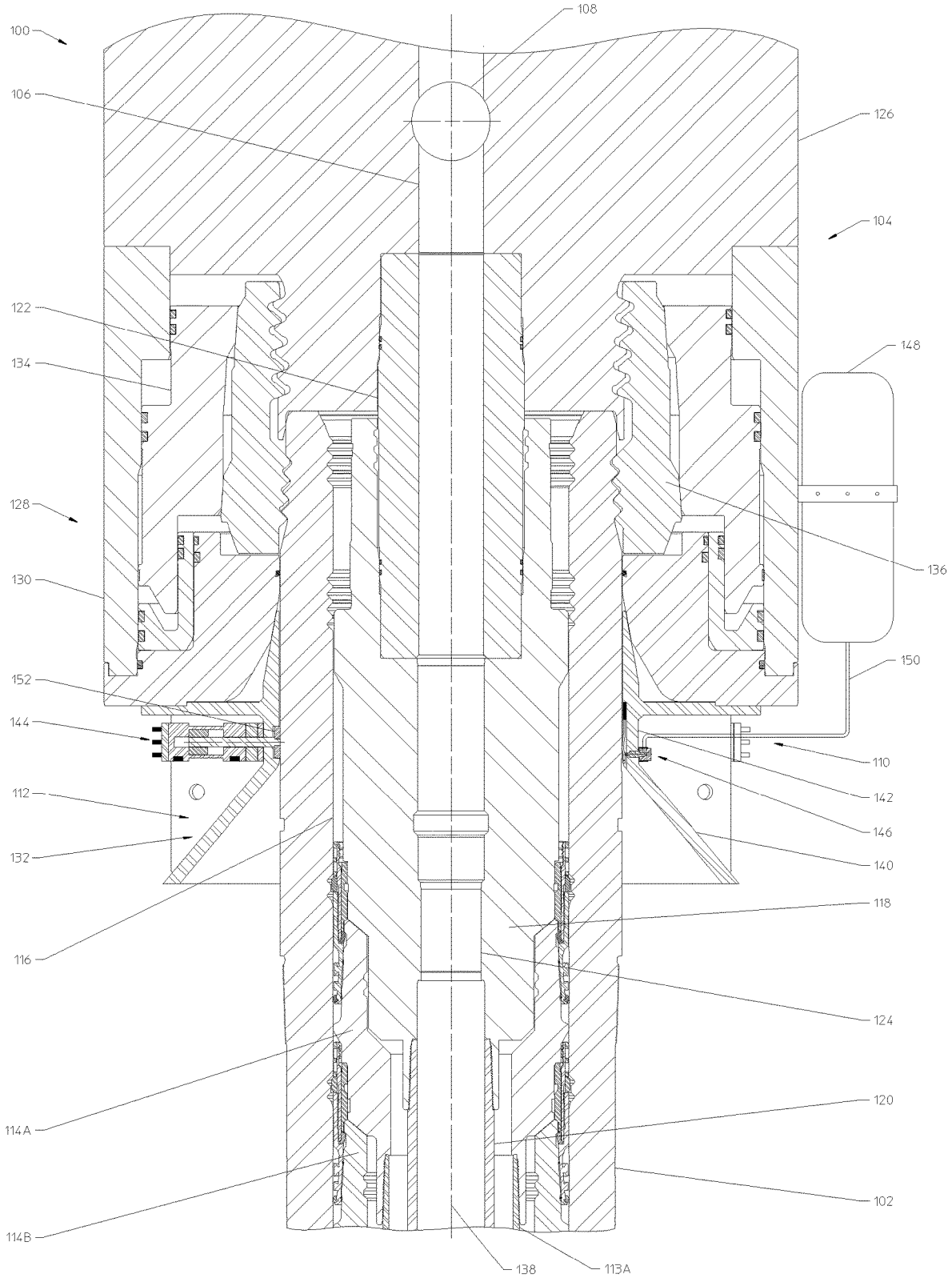
FIG. 1 is a schematic partial cutaway view of a subsea production system including a subsea tree wellhead connector equipped with a soft landing system, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of the present disclosure. Furthermore, in no way should the following examples be read to limit, or define, the scope of the disclosure.

Certain embodiments of the present disclosure may be directed to a subsea wellhead connector equipped with a soft landing system to facilitate landing of the wellhead connector (with any connected equipment) on or over a subsea wellhead. The soft landing system, upon actuation, may couple the wellhead connector directly to the subsea wellhead. The wellhead connector may be any desired equipment designed to connect directly to a subsea wellhead. In some embodiments, the wellhead connector may connect directly to an outer diameter of the subsea wellhead.

In some embodiments, the wellhead connector may be part of a larger subsea equipment component designed to be landed onto and directly connected to the wellhead. The larger subsea equipment component may be attached directly to the wellhead via the wellhead connector with the soft landing system. For example, the wellhead connector may form a lower part of a subsea tree or other subsea equipment designed to be landed on the wellhead. The wellhead connector may be used in a variety of types of subsea equipment that may be landed directly onto a subsea wellhead. For example, the wellhead connector may be part of a subsea tree, such as a vertical Christmas tree (VXT) having vertical flowlines formed therethrough and designed to be landed over the high pressure wellhead. In other embodiments, the wellhead connector may be part of a subsea tree taking the form of a horizontal Christmas tree (HXT) having horizontal flowlines and valving. In other embodiments, the wellhead connector may be part of a subsea production flowline connection body (with or without valving), a tubing spool that supports a tubing hanger and provides a means for attaching a separate tree to the wellhead/tubing, a tieback riser, a production riser, or another piece of production subsea equipment to be landed on a wellhead.

The disclosed soft landing system may be disposed on a body of the subsea wellhead connector. This body may include, for example, a guide funnel and/or a frame of the wellhead connector. The body may be at least partially cylindrical in shape with a bore formed therethrough, the bore configured to be disposed around and lowered onto the cylindrical subsea wellhead.

The disclosed soft landing system includes one or more hydraulic cylinder assemblies coupled to the body of the subsea wellhead connector and one or more valve assemblies coupled to the body of the subsea wellhead connector. Each cylinder assembly generally includes a barrel, a rod disposed within the barrel and extending in one direction from the barrel, and a soft land pad disposed on an extended end of the rod. The one or more valve assemblies are each fluidly coupled to the one or more cylinder assemblies. As the wellhead connector (and any attached equipment) having the soft landing system is lowered over the wellhead, the valve assemblies may automatically open upon the wellhead connector reaching a predetermined vertical position over the wellhead. The opened valves may allow communication of pressurized hydraulic fluid to the one or more cylinder assemblies, thereby actuating the cylinders to extend the rods until the pads at the ends of the rods directly engage the wellhead. This provides a soft landing of the wellhead connector (and any attached equipment) being lowered onto the wellhead. Specifically, the soft landing system is designed to control and ease subsea equipment landing on the wellhead during installation of the subsea production system.

Turning now to the drawings, FIG. 1 illustrates certain components of a subsea production system 100 in which the disclosed wellhead connector with soft landing system may be utilized. The production system 100 depicted in FIG. 1 may include a subsea wellhead 102 and a subsea tree 104 (which may be a vertical or horizontal Christmas tree, or a flowline connection body). The subsea tree 104 is equipped with the disclosed subsea wellhead connector 128 having the soft landing system 110. However, as discussed above, the subsea wellhead connector 128 of FIG. 1 may be similarly attached to any number of different types of subsea equipment being landed on the wellhead 102. The disclosed wellhead connector 128 with soft landing system 110 is not limited to use with a subsea tree 104, but may be similarly used with other equipment such as, for example, a spool, a tieback riser, or a production riser, among other things.

In the illustrated embodiment, the subsea tree 104 is shown schematically to be a vertical Christmas tree having a vertical production bore 106 formed therethrough and at least one valve 108 along the production bore 106. The tree 104 may include various valves for fluidly coupling the vertical bore 106 formed through the tree 104 to one or more downstream production flow paths, such a well jumper, for example. The tree 104 may also include an annulus bore (not shown) and associated valving. The tree 104 may be connected to and sealed against the wellhead 102. It should be understood that various other types of production equipment may be landed on, connected to, and sealed against the wellhead, and these other types of equipment may be similarly outfitted with the disclosed wellhead connector 128 and soft landing system 110.

In accordance with presently disclosed embodiments, the tree 104 includes the soft landing system 110 disposed on a body 112 (e.g., guide funnel 132) of the wellhead connector 128 of the tree 104. The soft landing system 110 facilitates a soft landing of the wellhead connector 128 (and the rest of the tree 104) onto the wellhead 102 during initial assembly of the subsea production system 100. As discussed in greater detail below, the body 112 of the tree 104 may include a guide funnel of the wellhead connector 128.

A typical method of assembling the subsea production system 100 will now be provided. It should be noted that other embodiments of the subsea production system 100 may include other types and combinations of subsea equipment that may be installed through different procedures than those described here, without departing from the scope of the present disclosure. In general, the method may include installing a low pressure conductor housing (not shown) on the sea floor and landing the high pressure wellhead 102 in the conductor housing. The method then involves running and securing a blowout preventer (BOP), not shown, to the top of the wellhead 102. The BOP may function as a fail-safe that can be used to seal the wellbore in response to undesirable pressure fluctuations downhole during drilling and completion operations. The BOP includes a vertically oriented bore through which drill pipe, casing, production tubing, and other equipment may be lowered.

Once the BOP is in place, one or more casing strings (e.g., 113A visible in FIG. 1) may be lowered through the BOP and the high pressure wellhead 102, such that the casing strings extend into the wellbore. The casing strings (e.g., 113A) may be landed in the wellhead 102 via corresponding hangers (e.g., 114A and 114B) that are disposed in a sealing engagement within a bore 116 of the wellhead 102. Once the casing strings are landed, the method may include running a tubing hanger 118 (and associated tubing 120) to the wellhead 102 and landing the tubing hanger 118 in a sealing engagement within the bore 116 of the wellhead 102. At this point, the BOP may be retrieved to the surface.

As illustrated in FIG. 1, the tubing hanger 118 may be landed in and sealed against the bore 116 of the wellhead 102. The tubing hanger 118 may suspend a tubing string 120 into and through the wellhead 102. Likewise, the one or more casing hangers (e.g., inner casing hanger 114A and outer casing hanger 114B) may be held within and sealed against the bore 116 of the wellhead 102 and used to suspend corresponding casing strings (e.g., inner casing string 113A and an outer casing string) through the wellhead 102.

The installation method may further include landing the subsea tree 104 onto the wellhead 102. The tree 104 may be equipped with an internal connector tube 122 designed to connect a production bore 124 of the tubing hanger 118 with the production bore 106 through a main portion 126 of the tree 104. In some embodiments, the illustrated internal connector tube 122 may include a tubing hanger alignment device designed to connect hydraulic, electric, and fiber optic lines between the tree 104 and the tubing hanger 118 regardless of a particular orientation in which the tubing hanger 118 or tree 104 is landed with respect to the wellhead 102. The soft landing system 110 may slow down the landing process of the tree 104 being lowered onto the wellhead 102, giving additional time for the internal connector tube 122 to orient the tree 104 properly with respect to the tubing hanger 118.

The tree 104 may include, among other things, the main portion 126 through which the production bore 106 extends, and the subsea wellhead connector 128 designed to attach the main portion 126 of the tree 104 to the wellhead 102. The wellhead connector 128 may include, among other things, a housing 130, a guide funnel 132, a piston assembly 134, and a lock ring 136. The guide funnel 132 generally functions to guide and then center the subsea tree 104 over the wellhead 102 as the wellhead connector 128 is first lowered over the top of the wellhead 102. A radially inner surface (relative to longitudinal axis 138) of the guide funnel 132 of the wellhead connector 128 is sized to be received around a radially outer surface (relative to the axis 138) of the wellhead 102. The guide funnel 132 may include a frustoconical portion 140 that extends radially outward in a downward direction, and this frustoconical portion 140 guides the entire wellhead connector 128 (and subsea tree 104) into a position that is centered over the wellhead 104. As illustrated, the guide funnel 132 may also include a vertical portion 142 above the frustoconical portion 140, the vertical portion 142 having a vertically oriented cylindrical wall designed to be received over and in close proximity to the radially outer surface of the wellhead 104.

As the tree 104 is lowered toward the top of the wellhead 102, the guide funnel 132 of the wellhead connector 128 may center and guide the tree 104 into position over the wellhead 102. As the wellhead connector 128 moves further down the wellhead, the soft landing system 110 may be automatically actuated to land and lock the wellhead connector 128 (and tree 104) in position at a desired location around the wellhead 102. The soft landing system 110 may help to ease the tree 104 into this final position around the wellhead 102. Upon landing the tree 104 in this desired position, the piston assembly 134 of the wellhead connector 128 may be actuated to force the lock ring 136 into contact with grooves on the wellhead 102, fully locking the tree 104 to the wellhead 102. A person of ordinary skill in the art would recognize that other systems and methods for fully locking the subsea tree 104 to the wellhead 102 may be used in other embodiments, without departing from the scope of this disclosure. For example, in other embodiments the soft landing system 110 may effectively lock the tree 104 to the wellhead 102. Once fully assembled, the tree 104 may function to direct production fluids in a controlled manner from the wellbore.

The disclosed soft landing system 110 may include, among other things, a number of subsea rated hydraulic cylinder assemblies 144 and valve assemblies 146 with associated components attached around an outside diameter of the body 112 of the wellhead connector 128. In the illustrated embodiment, for example, the hydraulic cylinder assemblies 144 and valve assemblies 146 (and other associated components) may be disposed around an outside diameter of the wellhead connector 128, and specifically the guide funnel 132 of the wellhead connector 128. More particularly, the hydraulic cylinder assemblies 144 and valve assemblies 146 may be disposed on the vertical portion 142 of the guide funnel 132. However, these hydraulic cylinder assemblies 144 and valve assemblies 146 may be located in other locations of a wellhead connector body 112 in other embodiments.

The soft landing system 110 may include one or more hydraulic cylinder assemblies 144 and one or more valve assemblies 146. Although just one hydraulic cylinder assembly 144 and one valve assembly 146 is visible in the cross section of FIG. 1, the soft landing system 110 may include additional hydraulic cylinder assemblies 144 and valve assemblies 146 located at other circumferential positions around the body 112 of the wellhead connector 128. The soft landing system 110 may also include an accumulator 148 and one or more fluid flow lines 150 fluidly coupled between the accumulator 148, the valve assemblies 146, and the hydraulic cylinder assemblies 144 for directing hydraulic fluid to operate the soft landing system 110.

Each hydraulic cylinder assembly 144 may include a corresponding soft land pad 152 attached to the end thereof. The soft land pad 152 is actuated against the wellhead 102 upon the wellhead connector 128 reaching a desired vertical position over the wellhead 102, thereby facilitating the desired soft landing of the attached tree 104 onto the wellhead 102. The guide funnel 132 and the valve assemblies 146 are used to guide the wellhead connector 128 into an appropriate position relative to the wellhead 102 prior to actuating the hydraulic cylinder assemblies 144 to lock the tree 104 in place (without using a downline).

The valve assemblies 146 are each designed to open a one-way valve disposed therein once the guide funnel 132 reaching a desired vertical position with respect to the wellhead 102, and opening this valve enables pressurized hydraulic fluid to flow from the accumulator 148 to the cylinder assemblies 144. The hydraulic fluid actuates the cylinder assemblies 144 to press the soft land pads 152 into contact with a radially outer surface of the wellhead 102. Since the opening of the valve assemblies 146 is triggered by the vertical location of the guide funnel 132 relative to the wellhead 102, the cylinder assemblies 144 are actuated such that the soft land pads 152 fully engage the wellhead 102 to halt the downward motion of the wellhead connector 128 at a known final landing position.

Figure 2:
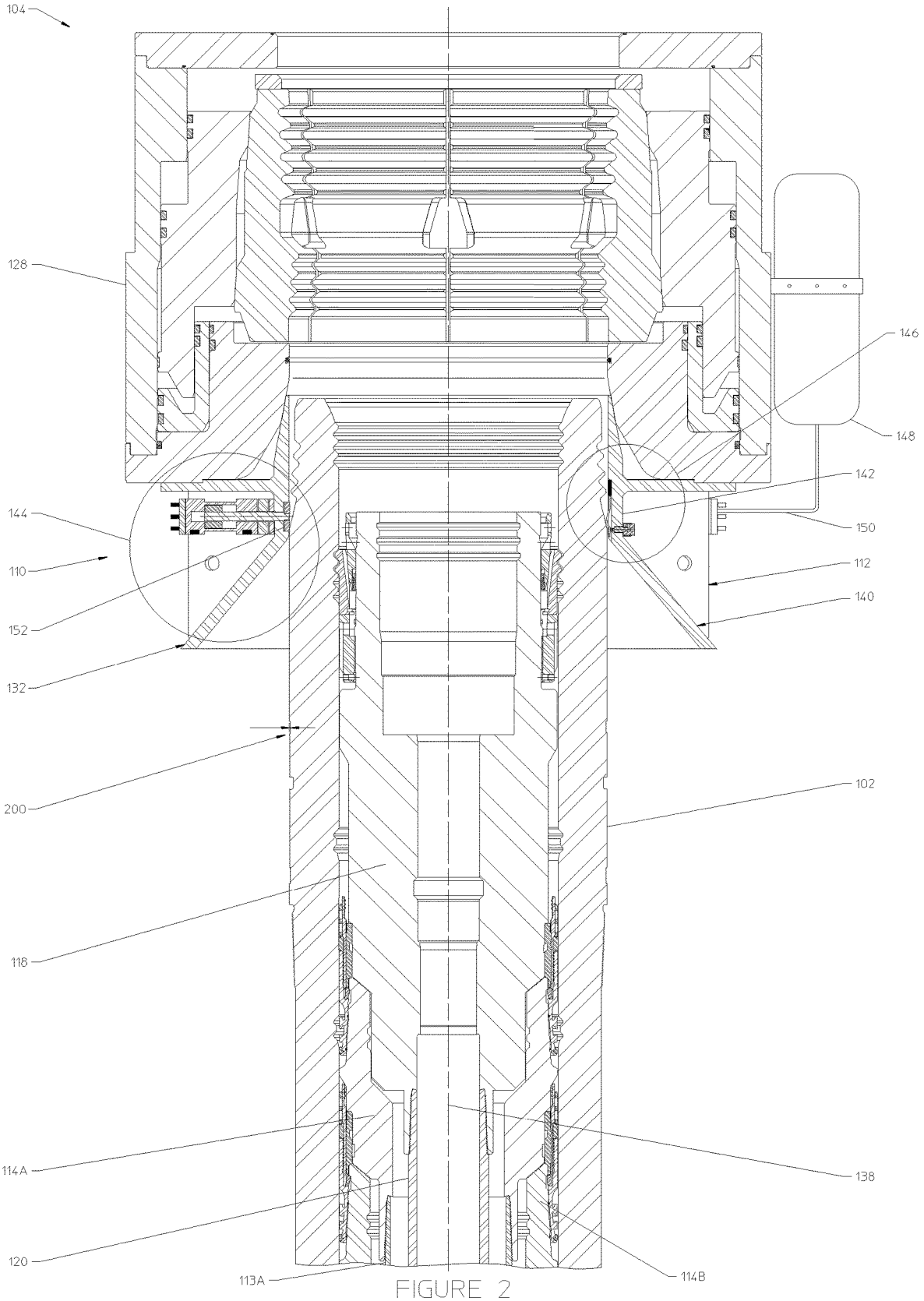
FIG. 2 is a schematic partial cutaway view of a wellhead connector equipped with a soft landing system being landed on a wellhead, in accordance with an embodiment of the present disclosure.

Having described the general application of the soft landing system 110 within the subsea production system 100 of FIG. 1, a more detailed description of the soft landing system 110 will now be provided. FIG. 2 illustrates the body 112 of the wellhead connector 128 being landed on the wellhead 102. Such a wellhead connector 128 may be used, for example, as part of a vertical subsea tree (as illustrated in FIG. 1), a horizontal subsea tree, a tubing spool, a subsea production flowline connection body, tieback riser, production riser, or some other subsea production equipment to be landed directly on the wellhead.

FIG. 2 shows the body 112 of the wellhead connector equipped with the disclosed soft landing system 110 as it is being lowered onto the wellhead 102. At the position of the wellhead connector body 112 shown in FIG. 2, the soft landing system 110 may be unactuated, or actuation of the soft landing system 110 may be just beginning. As in FIG. 1, a single hydraulic cylinder assembly 144 and a single valve assembly 146 are visible, although different numbers of these components of the soft landing system 110 may be utilized in the overall assembly.

Figure 3:
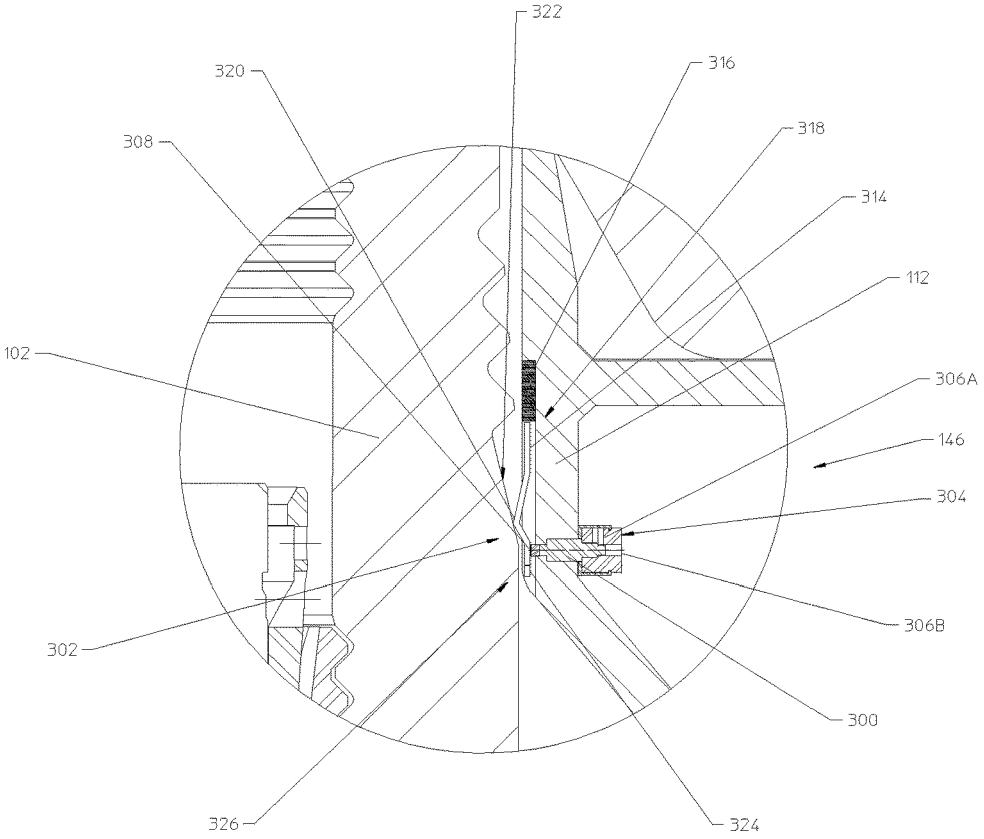
FIG. 3 is a detailed cross-sectional view of a check valve in the soft landing system of FIG. 2, in accordance with an embodiment of the present disclosure.

FIG. 3 shows a close up view of the valve assembly 146 of FIG. 2. In the soft landing system, each valve assembly 146 includes a one-way check valve 300 and an actuator component 302 to control the valve 300. The check valve 300 facilitates fluid flow through the valve assembly 146 moving in response to pressurized fluid flowing in one direction (from a fluid inlet to a fluid outlet) through the valve. The actuator component 302 automatically opens the check valve 300 when the wellhead connector body 112 reaches a desired vertical location with respect to the wellhead 102. In the illustrated embodiment, the check valve 300 may include a poppet valve. In other embodiments, however, the check valve 300 may include other types of one-way valves such as, for example, a needle valve.

The check valve 300 may be disposed inside a housing 304 having at least two flow path sections 306A and 306B formed therein. The check valve 300 may include a control button 308 internal to the check valve 300, and movement of the control button 308 may selectively transition the valve 300 between a closed position and an open position. The valve 300 is shown in the closed position in FIG. 3. When the valve 300 is in the closed position, the control button 308 seals an intersection of the flow path sections 306A and 306B within the valve 300 to close the valve 300. When the valve 300 is in the open position, the control button 308 is depressed within the valve 300 to unblock the intersection of the flow path sections 306A and 306B. The actuator component 302 may initiate the depression of the control button 308 in the valve 300. The control button 308 may include or be attached to a plunger or needle component extending into the intersection of the flow path sections 306. In some embodiments, the control button 308 may be spring-loaded or otherwise biased in a radially outward direction to close the valve 300 in the event of a loss of pressure from the accumulator (e.g., 148 of FIGS. 1 and 2) coupled to the inlet flow path section. The control button 308 extends through the wellhead connector body 112 for interfacing with the actuator component 302. The control button 308 may be temporarily held in the closed (non-depressed) position by the actuator component 302 until the wellhead connector body 112 reaches the position with respect to the wellhead 102 where the valve 300 is actuated.

In general, the actuator component 302 controls the valve 300. In the illustrated embodiment, the actuator component 302 may include an indicator rod 314 disposed proximate the control button 308. However, other types of actuator components 302 may be used in other embodiments to enable actuation of the check valve 300 when the wellhead connector body 112 reaches a desired vertical position.

The indicator rod 314 is configured to interface with the control button 308 to selectively depress the control button 308. The indicator rod 314 may be attached to a radially internal surface of the wellhead connector body 112 (e.g., guide funnel 132). Specifically, the indicator rod 314 may be attached to the wellhead connector body 112 via a compression spring 316 at an upper end 318 of the indicator rod 314. As shown, the indicator rod 314 may include a bend 320 formed therein, the bend 320 extending in a radially inward direction. This bend 320 is shaped to be at least temporarily captured by a sloped portion 322 of the radially outer surface of the wellhead 102.

The indicator rod 314 may also be equipped with a set key screw 324 toward a lower end 326 thereof, located below the bend 320. The set key screw 324 may have a specific shape configured to interface with the control button 308. For example, the set key screw 324 may include a groove or similar receptacle shaped to receive the control button 308 for actuation of the valve 300.

The actuator component 302 of FIG. 3 may operate as follows. Prior to actuation of the valve 300, a portion of the indicator rod 314 located above the set key screw 324 and below the bend 320 may be held against the control button 308, thereby preventing the control button 308 from being depressed in response to fluid pressure in one of the flow paths 306. As the wellhead connector body 112 (e.g., guide funnel 132) is lowered down around the wellhead 102, the bend 320 in the indicator rod 314 may easily slide past the upper part of the wellhead 102. Upon the wellhead connector body 112 reaching a position (against sloped portion 322) where the bend 320 can no longer slide past the wellhead 102, further downward movement of the wellhead connector body 112 forces the indicator rod 314 to move upward against the compression spring 316. As the indicator rod 314 slides upward relative to the wellhead connector body 112, the set key screw 324 is brought into alignment (in a radial direction) with the control button 308, thereby enabling the control button 308 to pop out against the set key screw 324. This allows the control button 308 to move the valve 300 from the closed position to the open position in response to pressurized fluid provided from the accumulator (e.g., 148 of FIGS. 1 and 2) pushing on the control button 308, which actuates the valve assembly 146. The purpose of the valve assembly 146 with this indicator rod 314 is to ensure the pads of the soft landing system are hydraulically actuated to hold the wellhead connector in place only at a designated position.

Figure 4:
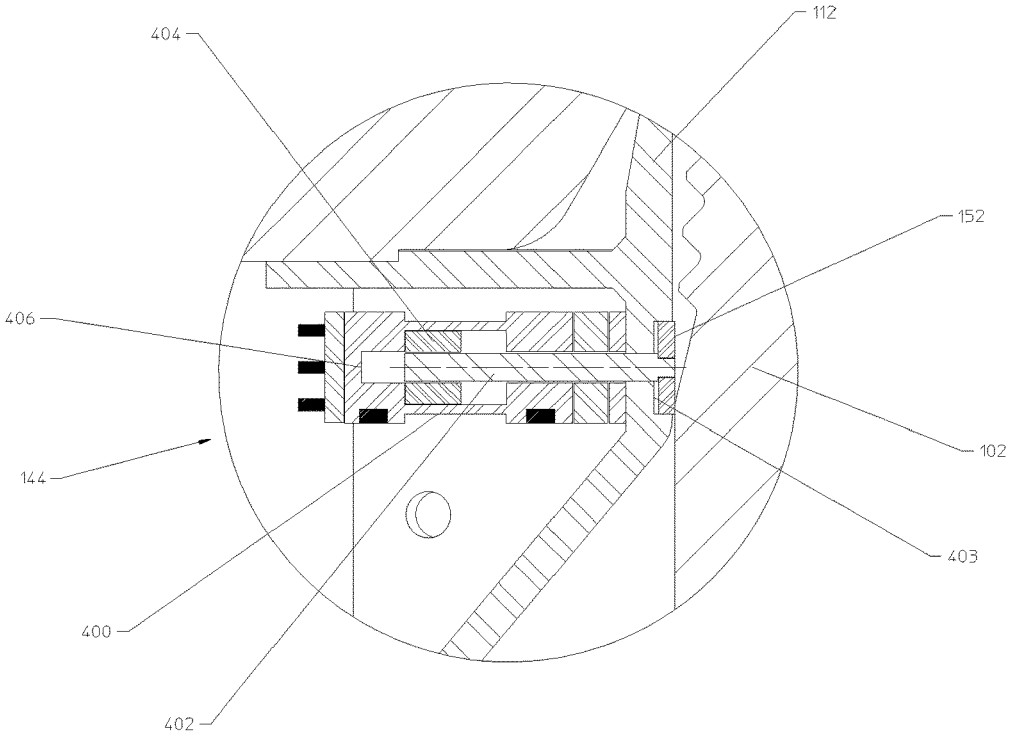
FIG. 4 is a detailed cross-sectional view of a hydraulic cylinder in the soft landing system of FIG. 2, in accordance with an embodiment of the present disclosure.

FIG. 4 shows a closeup view of the hydraulic cylinder assembly 144 of FIG. 2. In the soft landing system, each hydraulic cylinder assembly 144 may include a cylinder barrel 400, a cylinder rod 402 disposed at least partially within the barrel 400 and extending in one direction from the barrel 400. As illustrated, the rod 402 extends from the barrel 400 in a radially inward direction with respect to the longitudinal axis (e.g., 138 of FIGS. 1 and 2). The soft land pad 152 is attached to the extended end of the rod 402. The soft land pads 152 may be made of any desired material which is softer than the material of the wellhead 102. That way, the soft land pads 152 do not damage the wellhead housing upon being used to lower the wellhead connector onto the wellhead 102. In some embodiments, the soft land pads 152 may be constructed from materials such as, for example, tin, lead, hard plastics, or urethane. The material of the soft land pads 152 is capable of stopping the descent of and supporting the weight of the wellhead connector (and its attached equipment) along with any rotation torque.

As illustrated, the rod 402 may extend through an opening in the wellhead connector body 112 such that the soft land pad 152 is disposed proximate the radially outer surface of the wellhead 102. Before actuation of the hydraulic cylinder assembly 146, the soft land pad 152 may be positioned within a recess 403 formed in the radially inner surface of the wellhead connector body 112. The rod 402 is attached to a piston 404 at its opposite end from the soft land pad 152. The cylinder barrel 400 includes a housing surrounding a chamber 406, and the piston 404 is sealingly disposed within the chamber 406.

Applying pressurized fluid (e.g., hydraulic fluid) to the chamber 406 of the hydraulic cylinder assembly 144 forces the piston 404 and attached rod 402 in a radially inward direction with respect to the barrel 400. This causes the soft land pad 152 to directly engage the outer surface of the wellhead 102, locking the wellhead connector body 112 against the wellhead 102 at a desired location. The stroke length of the cylinder through which the hydraulic cylinder assembly 144 engages the wellhead 102 may be relatively short. For example, the hydraulic cylinder stroke length may be approximately ⅛ inch. However, other stroke lengths may be possible in other embodiments.

Each hydraulic cylinder assembly 144 may be fluidly coupled to one or more valve assemblies (e.g., 146 of FIGS. 1-3) of the soft landing system. The one or more valves assemblies (146 of FIGS. 1-3) may control application of pressurized hydraulic fluid to the chamber 406 within the cylinder barrel 400. As such, the disclosed soft landing system (e.g., 110 of FIGS. 1 and 2) provides a controlled and efficient method for locking a subsea wellhead connector (and any attached equipment) directly to a wellhead 102 at a predetermined position, without relying on a downline and remote operated vehicle (ROV) to control this positioning.

Turning back to FIG. 2, as the wellhead connector body 112 (e.g., guide funnel 132) is lowered onto the wellhead 102, a nominal gap 200 may be present between the wellhead connector body 112 and the wellhead 102. This nominal gap 200 as the wellhead connector body 112 is first lowered onto the wellhead 102 may be very tight. For example, the nominal gap 200 may be approximately 0.07 inch. This nominal gap 200 may help to align the attached equipment precisely against the wellhead 102. As discussed above, the one or more hydraulic cylinder assemblies 144 may have a short cylinder stroke (e.g., approximately ⅛ inch) to allow the soft land pads 152 to traverse this nominal gap 200. Upon actuation of the hydraulic cylinder assemblies 144, the soft land pads 152 may immediately stop the wellhead connector body 112 (and attached equipment) from sliding down or rotating around the wellhead 102. The soft land pads 152, upon actuation of the hydraulic cylinder assemblies 144 at a designated hydraulic pressure rate, may be able to hold up the weight and torque of the entire connected subsea production equipment (e.g., tree 104 of FIG. 1) during installation of the subsea production system.

Figure 5:
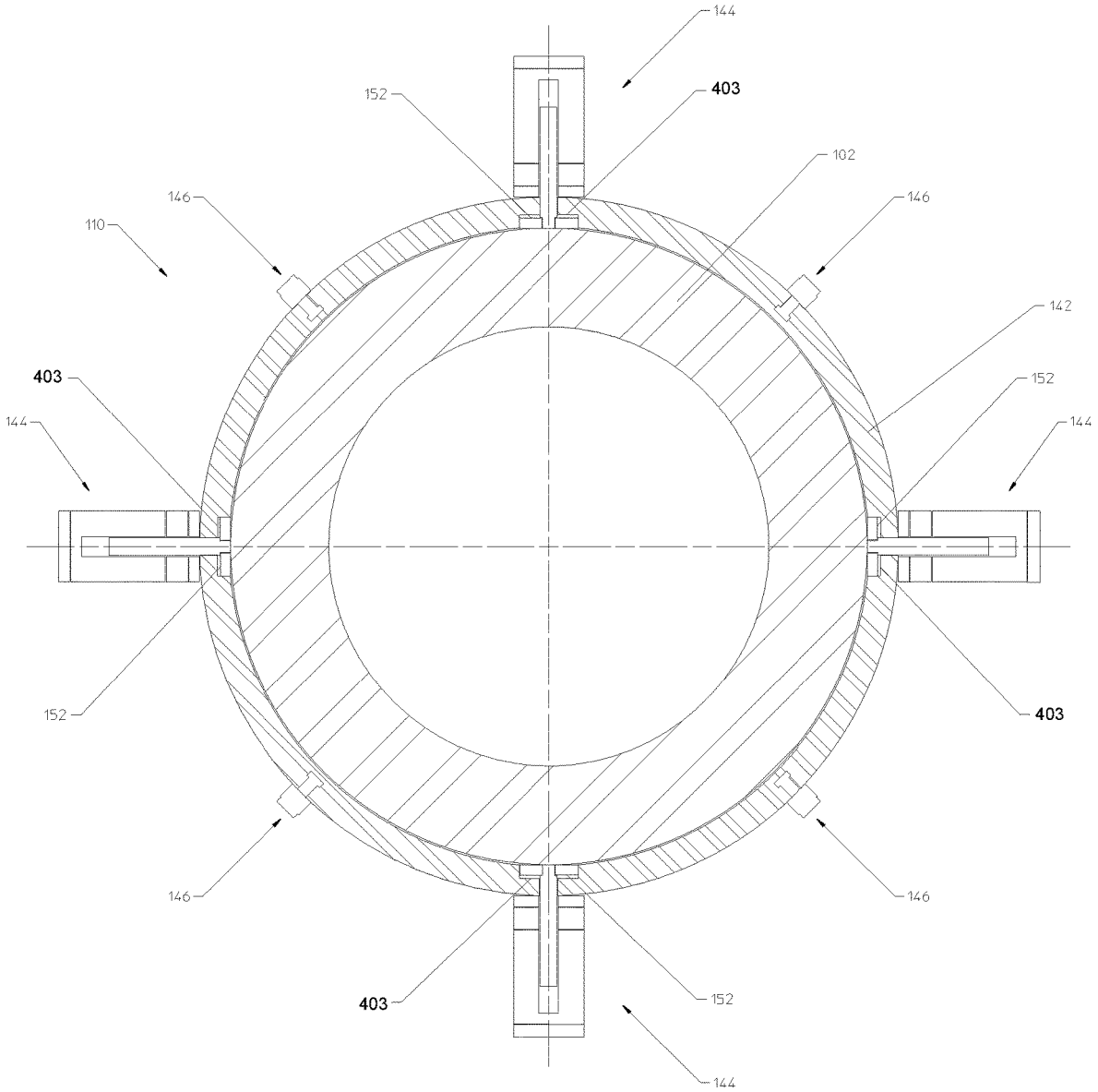
FIG. 5 is a schematic top section view of a wellhead connector body equipped with the soft landing system of FIG. 2, in accordance with an embodiment of the present disclosure.

FIG. 5 is a schematic diagram illustrating a possible layout of certain soft landing system components around the circumference of the body 112 of the wellhead connector. FIG. 5 specifically shows the wellhead 102 and the wellhead connector body 112 (e.g., funnel guide 132 of FIG. 2) with multiple hydraulic cylinder assemblies 144 and multiple valve assemblies 146 disposed therearound. As illustrated, the soft landing system 110 may include an equal number of cylinder assemblies 144 and valve assemblies 146 (e.g., 2, 3, 4, 5, 6, 7, 8 or more of each). In FIG. 5, for example, four cylinder assemblies 144 and four valve assemblies 146 are included in the illustrated soft landing system 110. In other embodiments, however, the soft landing system 110 may include unequal numbers of these components. For example, the soft landing system 110 may instead include a single valve assembly 146 and multiple cylinder assemblies 144, or two cylinder assemblies 144 and more than two valve assemblies 146. The soft landing system 110 may include multiple cylinder assemblies 144 and multiple valve assemblies 146, but with unequal numbers of the two types of assemblies.

The hydraulic cylinder assemblies 144 and valve assemblies 146 with associated components may be spaced equally around the outside diameter of the wellhead connector body 112, as shown. The hydraulic cylinder assemblies 144 may be interspersed with the valve assemblies 146 around the wellhead connector body 112. As illustrated, the cylinder assemblies 144 and valve assemblies 146 may each be disposed along a radially outer surface 300 of the wellhead connector body 112. Both the cylinder assemblies 144 and valve assemblies 146 have portions that extend at least partially into or through the annular body 112, as discussed above.

Figure 6:
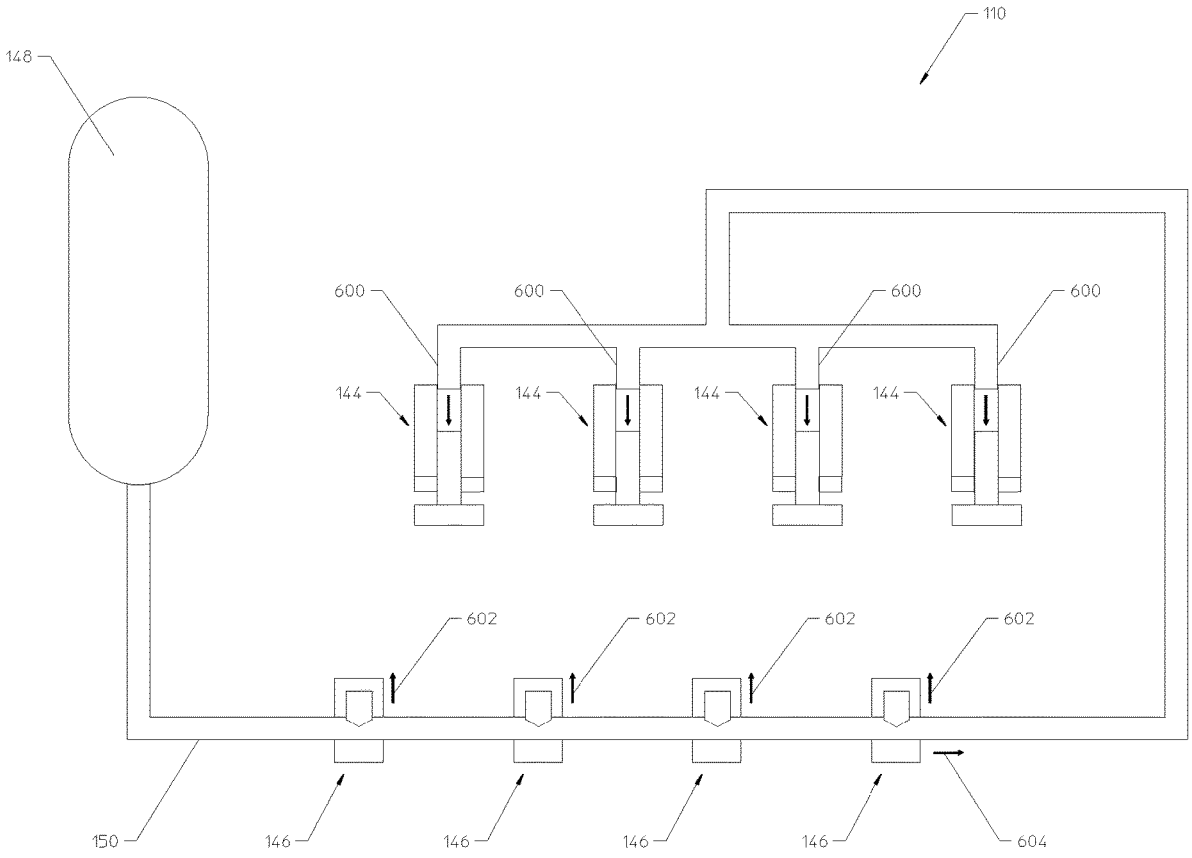
FIG. 6 is a schematic diagram illustrating hydraulic fluid flow within the soft landing system of FIG. 2, in accordance with an embodiment of the present disclosure.

FIG. 6 is a schematic diagram of an embodiment of the disclosed soft landing system 110, including hydraulic flow paths through which hydraulic fluid is communicated to actuate the soft landing system 110. The soft landing system 110 is shown separate from the components of the subsea wellhead connector in which it is used, to provide a clear depiction of how hydraulic fluid is moved through the system. A person of ordinary skill in the art would recognize that it is possible to arrange the illustrated flowlines spatially within the arrangement of hydraulic cylinder assemblies 144 and valve assemblies 146 of FIGS. 1, 2, and 5. It should be understood that this is one example of an arrangement of flowlines to fluidly connect the one or more hydraulic cylinder assemblies 144 and one or more valve assemblies 146, and that other possible arrangements of flowlines may be used in other embodiments.

As illustrated, the soft landing system 110 may include multiple hydraulic cylinder assemblies 144 and multiple valve assemblies 146. The multiple valve assemblies 146 may be fluidly coupled to each other in series. The valve assemblies 146 may be coupled to each other and to the accumulator 148 via a flowline 150. The flowline 150 may connect an inlet of a first valve assembly 146A to the accumulator 148, an outlet of the first valve assembly 146A to an inlet of the adjacent second valve assembly 146B, and so forth until each of the valve assemblies 146 is connected in series. An opposite end of the flowline 150 may be coupled to a series of flowline branches 600. The flowline branches 600 each fluidly connect the end of the flowline 150 to the chamber 406 of a corresponding one of the hydraulic cylinder assemblies 144. As such, the hydraulic cylinder assemblies 144 are fluidly connected to each other in parallel.

As a result of the above described configuration, all valve assemblies 146 have to be opened to allow fluid flow through the hydraulic cylinder assemblies 144. This ensures that the wellhead connector body is fully aligned in a desired vertical position with respect to the wellhead prior to actuating any of the hydraulic cylinder assemblies 144. As the wellhead connector body is lowered to the actuation position on the wellhead, the valve assemblies 146 may each be opened via their associated actuation components. This movement of the valve assemblies 146 to their open positions (arrows 602) enable pressurized fluid to flow (arrow 604) from the accumulator 148 toward the hydraulic cylinder assemblies 144. Since the hydraulic cylinder assemblies 144 are connected in parallel, all of the hydraulic cylinders 144 may be operated at the same time to provide an even clamping force against the wellhead on all sides of the wellhead connector body.

Figure 7:
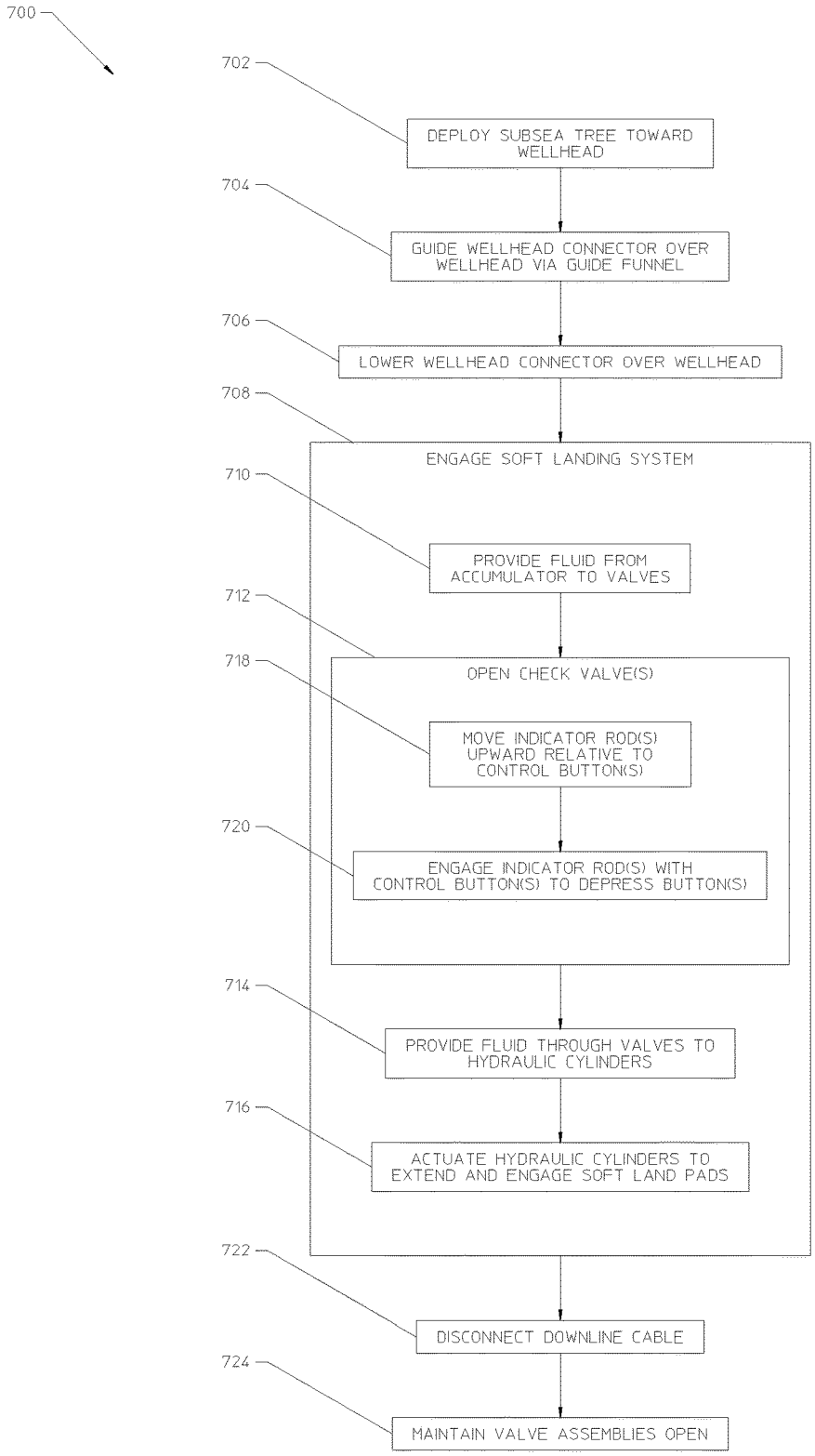
FIG. 7 is a process flow diagram illustrating a method of operating the soft landing system of FIG. 2, in accordance with an embodiment of the present disclosure.

FIG. 7 is a process flow diagram of a method 700 for operating the disclosed subsea wellhead connector with the soft landing system, in accordance with an embodiment of the present disclosure. This method is exemplary, and it should be understood that one or more steps of this illustrated method 700 may be performed in a different order, or eliminated, in other embodiments. In still other embodiments, the method 700 for operating the soft landing system may also include additional steps not shown in the illustrated embodiment, without departing from the scope of this disclosure.

The method 700 may include deploying (block 702) a subsea tree (or other piece of equipment having a wellhead connector) to a position above a subsea wellhead. The method 700 may include guiding (block 704) the wellhead connector over the subsea wellhead via a guide funnel of the wellhead connector. The method 700 may include lowering (block 706) the wellhead connector to a position at least partially over (or surrounding) the subsea wellhead. When the wellhead connector is in a desired position, the method 700 includes engaging (block 708) a soft landing system disposed on a body of the wellhead connector to couple the attached subsea tree (or other equipment) to the subsea wellhead. This engagement (block 708) of the soft landing system may include one or more of the following: providing fluid communication (block 710) from an accumulator disposed on the wellhead connector to one or more valve assemblies of the soft landing system; opening check valves (block 712) of the one or more valve assemblies to provide the fluid communication (block 714) from the accumulator through the check valves to the one or more hydraulic cylinder assemblies; and actuating (block 716) the one or more hydraulic cylinder assemblies such that the rod of each hydraulic cylinder assembly extends until its soft land pad engages the subsea wellhead. Opening (block 712) the check valves may include, for each check valve: moving an indicator rod (block 718) of the check valve upward relative to a control button of the check valve in response to the wellhead connector being lowered to a predetermined location over the subsea wellhead; and engaging the indicator rod (block 720) with the control button to selectively depress the control button to open a flowpath through the check valve. After engaging (block 708) the soft landing system, the method 700 may further include disconnecting a downline cable (block 722). The downline cable may be disconnected from the subsea tree (or other attached equipment) as soon as the soft landing system is operated to stop the tree from freefall. After engaging (block 708) the soft landing system, the method 700 may further include maintaining (block 724) the one or more valve assemblies open after actuating the one or more hydraulic cylinders, so that the valves remain open and the pressurized fluid accumulator is kept fluidly connected to the hydraulic cylinders.

Although the present disclosure and its advantages have been described in detail, it should be understood that various changes, substitutions and alterations can be made herein without departing from the spirit and scope of the disclosure as defined by the following claims.

What is claimed is:

1. A system, comprising:

a wellhead connector configured to be coupled to a subsea wellhead; and a soft landing system disposed on a body of the wellhead connector, the soft landing system comprising:

one or more cylinder assemblies coupled to the body of the wellhead connector, each cylinder assembly comprising a barrel, a rod disposed within the barrel and extending in one direction from the barrel, and a pad disposed on an extended end of the rod, wherein the rod extends from the barrel in a direction perpendicular to a longitudinal axis of the wellhead connector; and one or more valve assemblies coupled to the body of the wellhead connector, the one or more valve assemblies each fluidly coupled to the one or more cylinder assemblies.

2. The system of claim 1, wherein the one or more valve assemblies each comprise a poppet valve or a needle valve.

3. The system of claim 1, wherein the body of the wellhead connector comprises a guide funnel.

4. The system of claim 1, wherein the barrel of each cylinder assembly is located along a radially external surface of the body, and wherein the pad of each cylinder assembly is located along a radially inner surface of the body.

5. The system of claim 1, wherein the one or more cylinder assemblies are each equally spaced about a circumference of the body of the wellhead connector.

6. The system of claim 1, wherein the soft landing system comprises multiple cylinder assemblies fluidly coupled in parallel, and multiple valve assemblies fluidly coupled in series.

7. The system of claim 1, wherein each valve assembly comprises:

a control button configured to open a one-way valve upon depression of the control button; and an indicator rod disposed proximate the control button, wherein the indicator rod is configured to interface with the control button to selectively depress the control button.

8. The system of claim 7, wherein each valve assembly further comprises:

a set key screw at a first end of the indicator rod, wherein the set key screw has a complementary shape to an end of the control button; and a compression spring at a second end of the indicator rod, wherein the compressing spring attaches the indicator rod to the body of the wellhead connector.

9. The system of claim 7, wherein the indicator rod has a bent shape.

10. The system of claim 1, further comprising an accumulator fluidly coupled to the one or more valve assemblies.

11. The system of claim 1, further comprising the wellhead, wherein the wellhead connector is disposed around and attached to the wellhead via the soft landing system.

12. A method, comprising:

lowering a wellhead connector to a position at least partially over a subsea wellhead; and engaging a soft landing system disposed on a body of the wellhead connector to couple the wellhead connector to the subsea wellhead, wherein the soft landing system comprises:

one or more cylinder assemblies coupled to the body of the wellhead connector, each cylinder assembly comprising a barrel, a rod disposed within the barrel and extending in one direction from the barrel, and a pad disposed on an extended end of the rod, wherein the rod extends from the barrel in a direction perpendicular to a direction in which the wellhead connector is lowered with respect to the subsea wellhead; and one or more valve assemblies coupled to the body of the wellhead connector, the one or more valve assemblies each fluidly coupled to the one or more cylinder assemblies.

13. The method of claim 12, wherein engaging the soft landing system comprises:

opening one-way valves in the one or more valve assemblies to provide fluid communication through the one or more valve assemblies to the one or more cylinder assemblies; and actuating the one or more cylinder assemblies via the fluid communication such that the rod of each cylinder assembly extends until the pad engages the subsea wellhead.

14. The method of claim 13, wherein the soft landing system comprises multiple cylinder assemblies fluidly coupled in parallel and multiple valve assemblies fluidly coupled in series.

15. The method of claim 13, wherein opening the one or more valve assemblies comprises, for each valve assembly:

moving an indicator rod of the valve assembly upward relative to a control button of the valve in response to the wellhead connector being lowered to a predetermined location over the subsea wellhead; and engaging the indicator rod with the control button to selectively depress the control button to open a flowpath through the valve.

16. The method of claim 13, further comprising providing fluid communication from an accumulator disposed on the wellhead connector to the one or more valve assemblies and the one or more cylinder assemblies.

17. The method of claim 12, further comprising maintaining the one or more valve assemblies open after actuating the one or more cylinder assemblies.

18. The method of claim 12, further comprising guiding the wellhead connector over the subsea wellhead via a guide funnel of the wellhead connector, wherein the guide funnel comprises the body of the wellhead connector.

19. The method of claim 12, further comprising disconnecting a downline cable from a subsea tree having the wellhead connector upon engaging the soft landing system.

20. A system, comprising:

a soft landing system configured to be disposed on a body of a wellhead connector, the soft landing system comprising:

one or more cylinder assemblies, each cylinder assembly comprising a barrel, a rod disposed within the barrel and extending in one direction from the barrel, and a pad disposed on an extended end of the rod;

one or more valve assemblies, each fluidly coupled to the one or more cylinder assemblies;

a control button configured to open a one-way valve in the one or more valve assemblies upon movement of the control button; and an indicator rod disposed proximate the control button, wherein the indicator rod is configured to interface with the control button to selectively move the control button.

* * * * *